United States Patent [19]

Prouty

[11] Patent Number: 4,737,750

[45] Date of Patent: Apr. 12, 1988

[54] BISTABLE ELECTRICAL CONTACTOR ARRANGEMENT

[75] Inventor: Robert E. Prouty, Logansport, Ind.

[73] Assignee: Hamilton Standard Controls, Inc., Farmington, Conn.

[21] Appl. No.: 945,157

[22] Filed: Dec. 22, 1986

[51] Int. Cl.[4] ..... H01H 9/00

[52] U.S. Cl. ..... 335/177; 335/179; 335/182

[58] Field of Search ..... 335/177, 178, 179, 180, 335/181, 182, 229, 236, 244

[56] References Cited

U.S. PATENT DOCUMENTS

| | | | |
|---|---|---|---|
| 1,252,312 | 1/1918 | Warren . | |
| 2,505,904 | 5/1950 | Matthias et al. | 175/341 |
| 3,218,523 | 11/1965 | Benson | 317/172 |
| 3,683,239 | 8/1972 | Sturman | 317/150 |
| 3,755,766 | 8/1973 | Read, Jr. | 335/229 |
| 3,848,206 | 11/1974 | Prouty et al. | 335/193 |
| 3,886,507 | 5/1975 | Johnston et al. | 335/234 |
| 3,914,723 | 10/1975 | Goodbar | 335/79 |
| 4,065,739 | 12/1977 | Jaffe et al. | 335/234 |
| 4,306,207 | 12/1981 | Tada et al. | 335/234 |
| 4,418,374 | 11/1983 | Callan | 361/167 |
| 4,419,643 | 12/1983 | Ojima et al. | 335/234 |
| 4,527,216 | 7/1985 | Stammely | 361/156 |
| 4,536,728 | 8/1985 | Cyrot | 335/182 |

*Primary Examiner*—H. Broome
*Assistant Examiner*—Lincoln Donovan
*Attorney, Agent, or Firm*—Stephen A. Schneeberger

[57] ABSTRACT

A bistable electrical contactor employs a one-piece permanent magnet plunger operating in conjunction with an aligned pole piece and a pair of oppositely-wound coils to afford pulse-operated bistable operation of the associated contacts. The coils are wound in opposition to provide respective opposite electromagnetic fields, one "aiding" and one "opposing" the inherent magnetic flux of the plunger. The plunger may be spring-biased toward one of its two bistable positions, typically the one in which the plunger is most remote from the pole piece. When an appropriate coil is briefly energized, the respective "aiding" or "opposing" force is respectively added to or subtracted from the inherent magnetic force of the plunger to cause the appropriate change of state. The pole piece is structured and positioned to facilitate interaction with the plunger. An adjustable stop arrangement minimizes bounce of resiliently-mounted contacts.

4 Claims, 2 Drawing Sheets

BISTABLE ELECTRICAL CONTACTOR ARRANGEMENT

DESCRIPTION

1. Technical Field

The technical field herein includes electromagnetic circuits and arrangements and particularly such arrangements as are used to implement bistable electrical switching operations.

2. Background Art

Numerous arrangements have been developed for providing bistable operation of electrical contactors or solenoids. In most, some type of relatively permanent magnet is employed to maintain an armature at a desired position without relying on a constant electromagnetic field. Examples of such systems have been disclosed in U.S. Pat. Nos. 1,252,312; 3,218,523; 3,914,723; 4,065,732 and 4,306,207.

In U.S. Pat. No. 1,252,312, a plunger of soft steel is magnetized and demagnetized either by reversal of current flow through a single coil or by current flow through a pair of reversed coils. Coils of differing sizes are used and a principal of residual magnetism is employed.

U.S. Pat. No. 3,218,523 discusses the use of a permanent magnet plunger which is attracted to or repelled from a fixed pole piece by reversal of current flow through a single coil.

U.S. Pat. No. 3,914,723 is directed toward a clapper armature relay in which the permanent magnet armature is attracted to or repelled from the core using a single coil with reversal of current flow. The patent, however, neither suggests using a solenoid plunger nor does it urge the use of dual coils.

U.S. Pat. No. 4,065,739 discloses a solenoid mechanism with a rubberized or flexible permanent magnet wrapped around the plunger. The plunger is actuable with a single coil by reversal of DC potential. The plunger, however, is not considered to be a permanent magnet.

U.S. Pat. No. 4,306,207 discloses a solenoid arrangement having a permanent magnet which is either part of the plunger or a fixed pole piece. However, the permanent magnet plunger or the permanent magnet core displays three piece construction with the permanent magnet sandwiched between two ferrite pieces. An operating coil and a return coil are used for bidirectional operation.

U.S. Pat. No. 3,886,507 is directed to an adjustable magnetic latch for a relay device. The arrangement is designed as a solenoid having a stationary set of magnets. The plunger is threaded and adjustable in location with respect to actual actuating shaft in order to affect an anti-bounce adjustment.

Although the foregoing patents individually disclose various different configurations and techniques for affecting bistable operation of a contactor or solenoid, it is desirable to provide a singular construction which is single, economical, and reliable.

Disclosure of Invention

According to the invention herein, a bistable electrical contactor employs a singular permanent magnet core in lieu of a conventional soft iron core operating in conjunction with a dual coil winding arrangement to enable pulse-operated bistable operation of the contacts. In particular, one coil is so wound and energized as to contribute to the permanent magnet force and the other coil is so wound and energized to oppose the permanent magnet force. A pulse of short duration through either coil will produce its associated bistable position. Operation is facilitated by the inclusion of a pole element which enhances magnetic communication between the permanent magnetic core and the dual coil windings. Further still, the objects of the invention are met by incorporation of the foregoing structure in a solenoid having a general configuration similar to that in U.S. Pat. No. 3,848,206 to Prouty et al for "Electromagnetic Solenoid With Improved Contact Antibounce Means", owned by the assignee of the present application and incorporated herein by reference.

Further according to the invention herein, a DC supply is controlled by an electronic circuit or the like in a means effective to operate a bistable solenoid. The circuit may include an electronic pulse source which is switched in a known manner in alternation to the aiding and the opposing coil windings for creating an electromagnetic field which acts upon the permanent magnet to oppose or support bias spring action on the plunger in opening or closing the contacts of the contactor arrangement.

Other features and advantages will be apparent from the specification and claims and from the accompanying drawings which illustrate an embodiment of the invention.

BEST MODE FOR CARRYING OUT THE INVENTION

Figure 1:
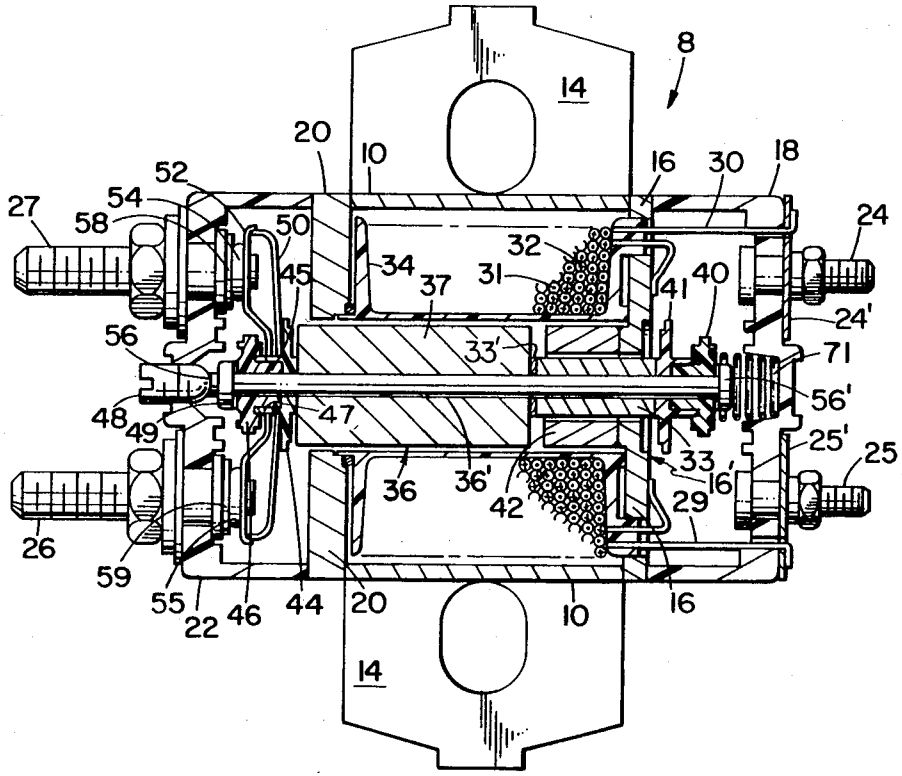
FIG. 1 is a vertical cross-section of the bistable electrical contactor arrangement constructed in accordance with the invention herein.

Shown in FIG. 1 is a bistable electrical contactor arrangement 8 constructed in accordance with the present invention. In many respects, the contactor arrangement is similar to the solenoid in the aforementioned U.S. Pat. No. 3,848,206 to which reference may be made for additional details to the extent consistent herewith. The contactor arrangement 8 includes a tubular central portion 10 formed, for example, of cold rolled steel or other suitable magnetizable material. Housing central portion 10 is axially between an upper end closure 18 and a lower end closure 22 of housing 9. The housing end portions 18 and 22 are suitable electrically insulating material as, for example, phenol plastic. The central portion 10 has a plurality of tabs (not shown) which are bent over closures 18 and 22 to hold the arrangement 8 together in a conventional fashion.

Fixed to the central portion 10 by suitable means is a mounting bracket 14. A washer 16, formed of suitable magnetizable material, is disposed between the central portion 10 and the upper end portion 18 of housing 9 and forms the annular head portion of a "T-shaped" or "mushroom shaped" pole piece 16' to be described hereinafter in greater detail. Another washer element 20, also made of suitable magnetizable material, is disposed between the housing center portion 10 and the lower end closure 22.

Conventional threaded terminals 24 and 25 are insertably mounted in suitable respective upper apertures defined in upper end closure 18 of housing 9. These are connected through terminal plates 24' and 25' to respective electrically conductive leads 29 and 30 which in turn are respectively connected to first and second electromagnetic coil windings 31 and 32 for respectively establishing oppositely directed electromagnetic fields, as will be seen.

In particular, first and second electromagnetic coil windings 31 and 32 are connected respectively to said terminals 24 and 25 so that when a voltage pulse of the proper level and polarity is appled to one of the terminals 24 and 25, a respective one of the coil windings 31 and 32 will be briefly energized and the contactor arrangement 8 will assume a respective one of its bistable states, "open" or "closed", as will be described.

In particular, FIG. 1 shows coil bobbin 34, about which coil windings 31 and 32 are oppositely wound, mounted axially within the housing central portion 10. Bobbin 34 is preferably made of plastic material and is held axially within central portion 10 between washers 16 and 20.

Bobbin 34 and washers 16 and 20 include central apertures extending axially therethrough and in which is positioned a magnetic plunger arrangement 36. The plunger arrangement 36 is axially movable to switch between "open" and "closed" states of bistable contactor arrangement 8. Plunger arrangement 36 includes a central bolt 36' which extends from its lower end 56 to its upper end or head 56'. The bolt 36' in effect holds together the remaining elements of plunger arrangement 36 which include in series, beneath head 56', electrically insulative washers 40 and 41, a bushing 33 preferably of brass, a shim 33' if necessary, a one-piece permanent magnet plunger 37, insulative washer 44, contact bridge elements 50 and 52 and insulative washer 46. These elements are held in place by the bolt 36' being inserted axially through a central aperture in each of the elements, and a nut 49 being tightly engaged at the end 56 thereof.

A tubular magnetic pole element 42, preferably of soft iron, depends axially from washer 16, as by being welded thereto, to form the remainder of pole piece 16'. Pole element 42 encircles bushing 33 in spaced relation therewith. Pole element 42, and thus pole piece 16', extends within bobbin 34 and coils 31 and 32 to communicate with the magnetic flux lines generated therein. Pole element 42 further has sufficient thickness and length to communicate the flux to plunger element 37, thereby enhancing the attractive or repulsive force therebetween as occasioned by the relatively additive or subtractive component of electromagnetic flux.

Thus, when either of the electromagnetic coils 31 and 32 is energized, a particularly effective magnetic flux path is created from plunger arrangement 36, through the pole piece 16' formed of pole element 42 and washer 16, through tubular central portion 10, then through washer 20 and finally back to arrangement 36. Accordingly, plunger arrangement 36 is attracted or relatively repelled in enhanced fashion with respect to pole element 42 of pole piece 16'.

Insulative washer 46 has a hub 45 which is adapted to insertably fit inside hub 47 of washer 44. A generally C-shaped upper spring member 50 is mounted about washer hub 47. Spring member 50 exerts a force on lower spring member 52, also mounted about washer hub 47 and having downwardly-directed contact elements 54 and 55 mounted at opposite ends thereof. Spring members 50 and 52 are free to slide axially on hub 47 between washers 44 and 46. Contact elements 54 and 55 are effective for making and breaking contact with fixed contact elements 58 and 59 and terminals 27 and 26, respectively.

The bistable contactor arrangement herein is shown in FIG. 1 in the "closed" one of its two bistable positions. A bias spring 71 acts in compression on plunger arrangement 36 to urge it toward the "closed" position. When the appropriate one of the electromagnetic coils 31 and 32 is energized, an "additive" electromagnetic flux will exist and the arrangement 36 will be attracted with respect to pole element 42. The cumulative force of attraction between arrangement 36 and the electromagnetic flux at pole piece element 42 overcomes the force exerted by spring 71 and the arrangement 36 moves upwardly. Because plunger element 37 is made of permanent magnetic material and pole piece 16' is of magnetizable material, once plunger 37 comes in contact with pole element 42, it will tend to stay there stably even after the additional electromagnetic force ends. The force of the inherent magnetic field of plunger 37 acting on pole piece 16' maintains the stable "open" position, even though alone it would not suffice to overcome the air gap between arrangement 36 and pole piece element 42 to establish that position. Thus, with arrangement 36 in its fully upward position, the circuit between terminal 26 and terminal 27 through contacts 55 and 54 will be and will remain "open".

Similarly, an opposite "subtractive" electromagnetic field can sufficiently negate the field of plunger 37 to break the connection between arrangement 36 and pole element 42, enabling contacts 54 and 55 to "close" and stay stably "closed" under the bias of spring 71.

Notably, this particular contact arrangement permits arrangement 36 to overtravel to a limited extent. It is believed that overtravel and contact bounce are closely related in this type of contact structure. For example, referring to the contacts 54 and 55 in FIG. 1, it can be seen that when the correct one of electromagnetic coils 31 and 32 is energized, plunger 36 will be moved to its full upward position and contacts 54 and 55 will be disengaged. Also, spring member 63 will be bowed slightly. However, when the other of coils 31 and 32 is energized causing an electromagnetic field in the other direction, the compression spring 71 will force the armature 36 to its deenergized, or "closed", position. At this point, if the plunger 36 still has enough kinetic energy to overtravel slightly, this will create a force which directly opposes the force of spring 71. Thus, the contacts 54 and 55 will bounce out of engagement. Normally, the electrical connection is quickly reestablished. However, there may be circumstances in which the bounce is particularly acute and the opposing electromagnetic field is terminating or terminated, thus creating a ride of return to the "open" position.

By threading an adjustable stop member 48 through the lower end closure 22 and adjusting it properly, overtravel can be minimized, thus minimizing contact bounce. Bolt end 56 of plunger arrangement 36 will contact the stop member 48 simultaneously with engagement between contact pairs 54, 58 and 55, 59. Stop member 48 will thus absorb the kinetic energy which would otherwise result in this overtravel and bounce.

It has been found that the adjustment of the stop member 48 is a fairly critical procedure, and that the best method for doing this utilizes an oscilloscope. Terminals 27 and 26 may, for example, be connected to a voltage source, and a series resistor, and an oscilloscope can be used to measure the voltage change across the resistor as contacts 54 and 55 close.

Figure 2:
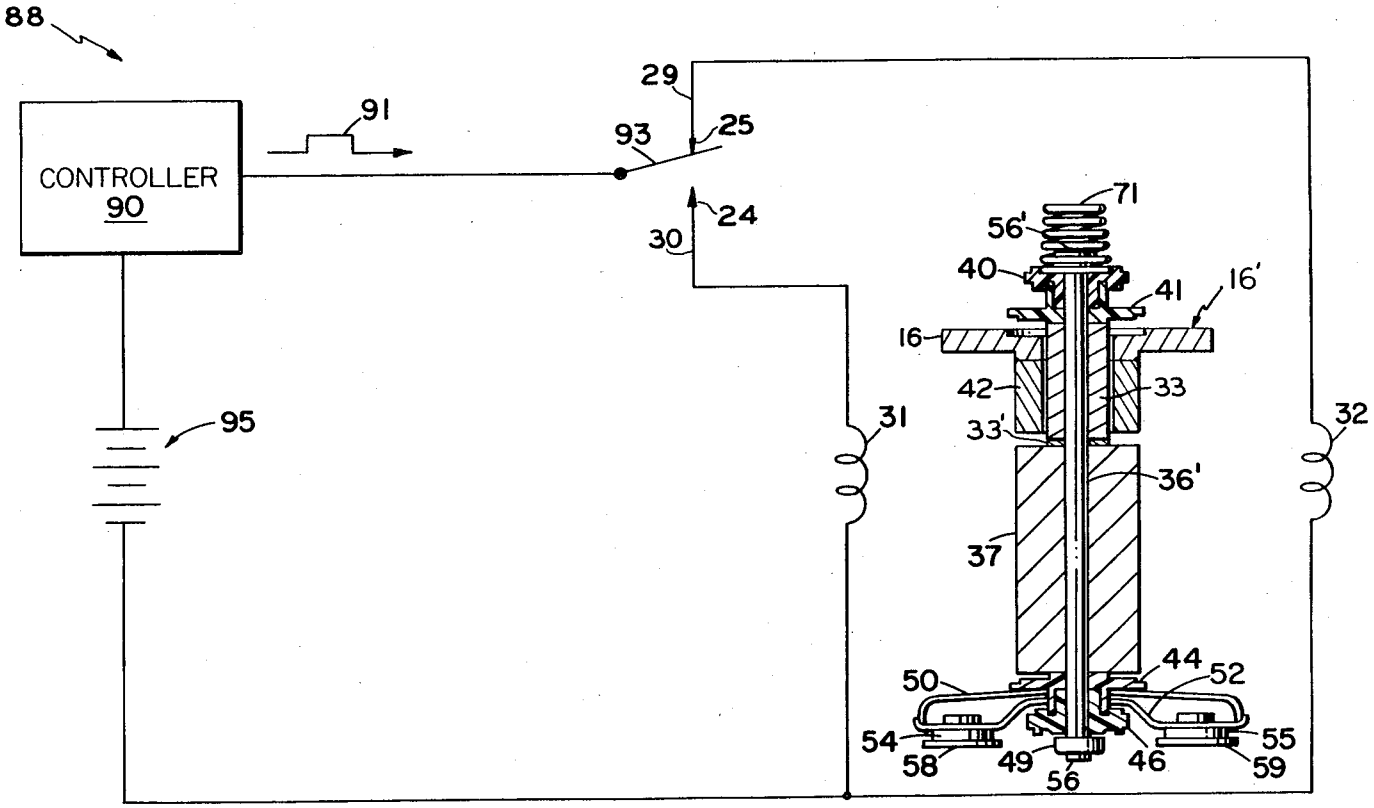
FIG. 2 shows a generalized electronic circuit arrangement effective for driving the operation of the bistable electrical contactor arrangement according to the invention herein.

FIG. 2 shows a generalized circuit arrangement 88 for energizing a selected one of coils 31 and 32 with a suitable level pulse of voltage and current. In particular, controller 90 is of suitable known design and is effective for sending an electric pulse 91, as derived, for example, from DC power source 95, through switch 93 to one or the other of coils 31 and 32. This effectively closes contacts 54 and 55 with respect to corresponding elements 58 and 59, subject to "bounce control" by stop 48 or, in alternation, enables opening of the contacts 54 and 55 subject to damping by spring 71. Pole piece 42 enhances the opening and closing of contacts 54 and 55 by concentrating the magnetic flux being directed from coil 31 or 32 through piece 42 to plunger element 36. The switch 93 and pulse 91 are depicted in generalized diagrammatic form in FIG. 2 and might be provided simply by the manual actuation of a momentary contact toggle switch. More typically, the "toggling" action and possibly also the pulse generation will be provided electronically in a known manner.

It should be understood that the invention is not limited to the particular embodiments shown and described herein, but that various changes and modifications may be made without departing from the spirit and scope of this novel concept as defined by the following claims.

I claim:

1. A bistable electrical contactor arrangement comprising:

stationary first and second spaced terminals mounted in a housing structure and including respective stationary first and secondary contacts;

a pair of opposing coils of magnet wire wound oppositely about a common hollow-core bobbin in the housing structure to provide an "aiding" and an "opposing" magnetic field, respectively;

a movable plunger arrangement axially reciprocable in the core of the bobbin within said housing structure between first and second bistable positions in response to selective energization of opposite ones of said coils in said pair, said plunger arrangement including a one-piece permanent magnet means for responding to magnetic conditions in the core region of said bobbin subject to an inherent magnetic bias, said one-piece permanent magnet comprising at least the major magnetic material of said plunger;

bridging contact means carried by said plunger arrangement for making and breaking contact between said stationary first and second contacts in said first and second bistable positions, respectively;

spring means cooperating with said plunger arrangement for biasing said plunger arrangement toward one of said first and second bistable positions; and pole means fixedly positioned in the housing structure for enhancing flux communication between said permanent magnet means and said pair of opposing coils when either of said coils is energized, said pole means including a pole piece portion, said permanent magnet means being in juxtaposed proximity with said pole piece portion when positioned in the other of said first and second bistable positions and being retained in said other of said first and second bistable positions by said inherent magnetic bias during absence of said energization of either coil of said pair.

2. The bistable electrical contactor arrangement of claim 1 wherein said pole means comprises an annular head portion and said pole piece portion, said pole piece portion being tubular and depending from said head portion.

3. The bistable electrical contactor arrangement of claim 2 wherein said pole piece portion is rigidly joined to said annular head portion of said pole means, said head portion overlies an end of said pair of coils at an end of said bobbin and said pole piece portion extends axially into the core of said bobbin.

4. The bistable electrical contactor arrangement of claim 3 wherein said bridging contact means is slidably mounted on said plunger arrangement, and further including a spring member carried by the plunger arrangement and biasing the bridging contact means toward said stationary first and second contacts, spring means biasing said plunger arrangement to one of the two bistable positions, and adjustable stop means mounted in the housing structure for limiting movement of said plunger arrangement in the direction of making contact with said stationary first and second contacts, said stop means being adjusted to minimize bounce of said bridging contact means upon deengerization of said pair of coils.

* * * * *